United States Patent [19]

Kurland et al.

[11] 3,978,489

[45] Aug. 31, 1976

[54] TUBULAR STRAIN ENERGY DEPLOYABLE LINEAR ELEMENT ANTENNA WITH STITCHED WIRE CONDUCTORS

[75] Inventors: Richard M. Kurland, Sherman Oaks; Gelb N. Fruktow, Los Angeles, both of Calif.

[73] Assignee: TRW Inc., Redondo Beach, Calif.

[22] Filed: June 2, 1975

[21] Appl. No.: 583,334

Related U.S. Application Data

[63] Continuation-in-part of Ser. No. 425,047, Dec. 14, 1973, abandoned.

[52] U.S. Cl. ..... 343/874; 343/881

[51] Int. Cl.[2] ..... H01Q 1/08

[58] Field of Search ..... 343/877, 896, 900, 915, 343/881

[56] References Cited

UNITED STATES PATENTS

| | | | |
|---|---|---|---|
| 3,364,488 | 1/1968 | Perenic et al. | 343/723 |
| 3,524,190 | 8/1970 | Killion et al. | 343/771 |

*Primary Examiner*—Eli Lieberman

*Attorney, Agent, or Firm*—Daniel T. Anderson; Donald R. Nyhagen; Jerry A. Dinardo

[57] ABSTRACT

A relatively low frequency linear element antenna characterized by its lightweight construction, relatively wide band width, and elastic strain energy deployment capability. The antenna has a plurality of slender electrical conductors such as wires forming radiating elements secured to a supporting tube with the conductors extending lengthwise of and spaced about the tube wall and electrically joined at the base end of the tube in such a way that the antenna has the same radiation characteristic as a conventional cylindrical antenna of the same diameter as the tube. The base ends of the conductors are gathered for connection to the center conductor of a coaxial antenna feed line to provide an impedance match between the antenna and coaxial line. The antenna supporting tube may comprise a thin-walled, resiliently flexible, strain energy deployable tube to permit contraction of the antenna to a folded or coiled packaged configuration and antenna deployment by elastic strain energy stored in the contracted tube.

3 Claims, 7 Drawing Figures

TUBULAR STRAIN ENERGY DEPLOYABLE LINEAR ELEMENT ANTENNA WITH STITCHED WIRE CONDUCTORS

The invention herein was made in the course of or under a contract, subcontract thereunder (or grant), with the Department of the Air Force.

This is a continuation-in-part of application Ser. No. 425,047, filed Dec. 14, 1973, now abandoned.

BACKGROUND OF THE INVENTION

1. Field of the Invention

This invention relates generally to antennas and more particularly to a novel lightweight relatively low frequency linear element antenna of relatively wide bandwidth.

2. Prior Art

As is well known to those versed in the antenna art, the ability of an electrical conductor to serve as a radiator of electromagnetic energy is related to its electrical dimensions, that is, to some characteristic length or diameter of the conductor compared to the wavelength of the energy being radiated. For relatively low frequencies on the order of 100 $MH_z$ or less and relatively low gain on the order of 3 dbi, or less, monopoles are practical antennas. Among the most common relatively low frequency monopole antennas are stubs, cones, cylinders, and whips.

A whip antenna is a monopole antenna having a length to radius ratio on the order of 1000. When such an antenna is sized to a quarter wavelength, it is capable of performance, at best, only over a relatively narrow frequency band width of about 1.1 to 1. This narrow bandwidth is not suitable for many antenna applications.

The bandwidth of a monopole antenna is increased by increasing its thickness or diameter. For example, an antenna with a length to radius ratio on the order of 50, commonly referred to as a stub or cylindrical antenna, may have a frequency bandwidth of about 1.35 to 1. Its minimum length can be reduced to about 0.15 times the wavelength. In the limit, cylindrical antennas can be constructed with a length to radius ratio on the order of 10. Such a cylindrical antenna may operate efficiently over a 3 to 1 frequency band width.

Conventional cylindrical antennas have certain inherent disadvantages which the present invention is designed to overcome. One of these disadvantages resides in the weight of the cylindrical antenna and its lack of adaptability to a deployable configuration. Thus, a conventional cylindrical antenna is essentially a relatively large diameter metal tube. As a consequence, the cylindrical antenna is relatively heavy and quite ill-suited to if not totally incapable of utilization in a deployable configuration. Another disadvantge of a conventional cylindrical antenna involves impedance matching of the antenna and its coaxial feed line. In order to provide an impedance match between the antenna and its coaxial feed line, the base end of the cylindrical antenna element or tube must be progressively reduced or tapered to the diameter of the inner coaxial conductor, which is difficult to accomplish. Without such a tapered impedance matching portion on the antenna, an impedance mismatch will exist which will significantly decrease the antenna gain.

SUMMARY OF THE INVENTION

This invention provides a novel linear element antenna which avoids the above noted and other disadvantages of the existing cylindrical antennas. More specifically, the invention provides a linear element antenna characterized by its lightweight construction, relatively wide frequency bandwidth, and deployment capability.

The improved linear element antenna of the invention, or linear antenna as it is hereafter referred to, has a plurality of slender linear conductors such as wires which serve as radiating elements. These conductors are secured to a thin-walled lightweight supporting tube with the conductors extending lengthwise of and spaced circumferentially about the tube. At one end of the tube, herein referred to as its base end, is a mounting base for attachment to a supporting structure. The base ends of the conductors are electrically joined for connection to the center conductor of a coaxial antenna feed line.

The sizing and spacing of the conductors are such that together they form an electromagnetic radiator which is the approximate electrical equivalent of a conventional cylindrical antenna of the same diameter as the conductor supporting tube. However, since this tube is constructed of a lightweight dielectric, the weight of the present improved antenna is substantially less than that of a conventional cylindrical antenna which uses a relatively heavy metallic tubular radiator. Another advantage of the improved antenna is that it may be made deployable by utilizing as its supporting tube a resiliently flexible tubular elastic strain energy beam which may be flattened and folded, coiled or otherwise deformed to a compact packaged configuration wherein the beam stores elastic strain energy for deploying or erecting the antenna to its normal linear configuration when released. For example, the tube may be constructed of fiberglass or a polymer film, such as MYLAR or FIBERGLASS, and have the tubular elastic strain energy beam cross-section described in U.S. Pat. No. 3,749,133.

Another feature of the invention is concerned with obtaining an impedance match between the antenna and its coaxial feed line. According to this feature, the base ends of the antenna conductors are gathered and joined into a single conductor for connection to the center conductor of the coaxial line. This gathering of the conductors provides a smooth electrical transition between the several antenna conductors and the coaxial line to provide an impedance match between the line and antenna. An additional feature of the described linear antenna resides in the fact that the antenna conductors are secured to the wall of the antenna supporting tube by stitching the conductors to the wall. The conductors are located within the tube so as to be shielded against exposure to the environment.

The particular linear antenna shown is a single element or monopole antenna which is the equivalent of a conventional cylinder or stub antenna. However, the antenna may also be arranged to operate as a cone antenna and may be used as the individual elements of more complex multi-element antenna systems such as resonant antennas (half wave dipole, bicone, cylindrical dipole), traveling wave antennas (rhombic), frequency independent antennas (log periodic dipole) and surface wave antennas (Yagi-Uda).

DESCRIPTION OF THE PREFERRED EMBODIMENTS

Figure 1:
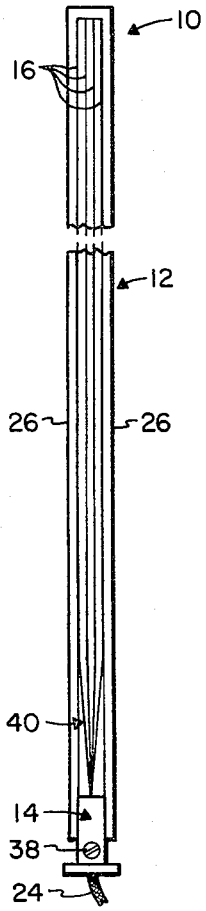
FIG. 1 is a longitudinal section through an elastic strain energy deployable antenna according to the invention showing the antenna in its deployed configuration.
Figure 2:
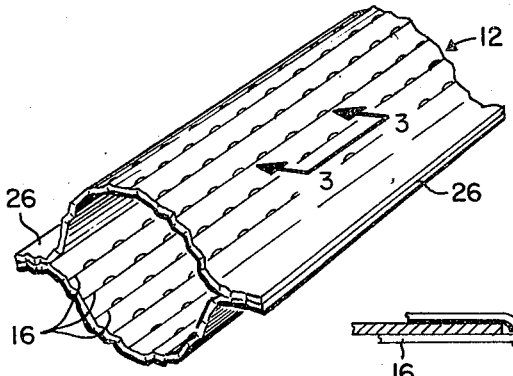
FIG. 2 is an enlarged fragmentary perspective view of the antenna supporting tube and conductors.

The linear antenna 10 illustrated in FIGS. 1–6 comprises a thin-walled, lightweight dielectric tube 12 having a mounting base 14 at one end for attachment to a supporting structure. Within the tube a plurality of slender electrical conductors 16, such as wires, are circumferentially spaced about and extend lengthwise through the tube from its outer end to its base end. As explained below, the conductors 16 are secured to the wall of the tube 12 which serves as a support for the conductors. The outer ends of the conductors are electrically joined by a ring conductor 18. For a major portion of their length from their electrically joined outer ends, the conductors 16 parallel one another and the axis of the tube 12. The base ends of the conductors separate from the tube wall and converge toward and are electrically joined on the tube axis to form a single lead-in conductor 20. This lead-in conductor extends through the mounting base 14 and is electrically joined to the center conductor 22 of a coaxial antenna feed line 24 which is fixed at one end to the mounting base.

As explained below, the conductors 16 are sized and spaced in a manner such that together they form an electromagnetic radiator which is the approximate electrical equivalent of a conventional cylindrical antenna of the same diameter as the antenna support tube 12. However, because the support tube is a lightweight dielectric tube, the linear antenna 10 is substantially lighter than a conventional cylindrical antenna.

Another advantage of the present linear antenna resides in its adaptability to elastic strain energy deployment by utilizing as the antenna support tube 12 a resiliently flexible tube which may be flattened and folded, coiled or otherwise deformed to a compact packaged configuration wherein the tube stores elastic strain energy for erecting or deploying the antenna to its normal linear configuration of FIG. 1 when released. The antenna 10 illustrated is so deployable.

To this end, the antenna support tube 12 comprises an elastic strain energy deployable tubular beam, such as the flanged beam described in U.S. Pat. No. 3,749,133. This tube or beam is constructed in two flanged half beam sections 12*a*, 12*b* that are fabricated by heat forming a light gage spring material which may comprise a polymer film, such as Mylar or Kapton, or fiberglass. The two half beam sections are then joined along their flanges to provide the finished beam. The flanges may be stitched to one another, as described in the patent, or otherwise joined, as by adhesive, welding or the like. As described in the patent, the beam may be flattened into the plane of its diametrically opposed flanges 26 and 28 and folded to a compact stowage or packaged configuration wherein the beam stores elastic strain energy for erecting or deploying the beam to its normal tubular configuration when released.

Figure 3:
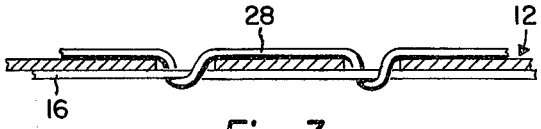
FIG. 3 is a further enlarged section taken on line 3—3 in FIG. 2.
Figure 4:
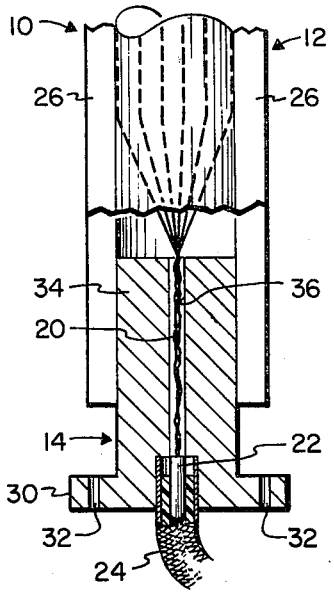
FIG. 4 is an enlarged side elevation, partially broken away, of the base end of the antenna.
Figure 5:
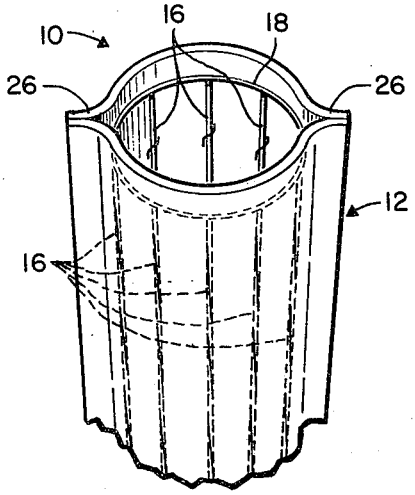
FIG. 5 is an enlarged perspective view of the outer end of the antenna.

As mentioned earlier, the conductors 16 are secured to the wall of the tube 12. According to the preferred practice of the invention, each conductor is attached to the wall by a dielectric thread 28 which extends along the outside of the tube opposite the conductor and which, at intervals, penetrates the tube wall and encircles the conductor, as shown in FIG. 3. The conductors may be thus secured to the two half beam sections 12*a*, 12*b* prior to joining of these sections to form the completed beam. This attachment of the wires to the tube by stitching attains the unique advantage of permitting relative endwise slippage between the wires and tube during stowage and deployment of the antenna. As a consequence, the wires and their attachment menas, i.e. stitching, do not inhibit strain energy deployment of the antenna, as would occur if the wires were adhesively bonded to the tube wall, for example. Thus, if the wires were adhesively bonded, retention of the antenna in its folded or coiled packaged configuration, would cause the adhesive bonds to creep and thereby resist antenna deployment. The base ends of the conductors are not attached to the tube wall to permit these ends to be gathered and electrically joined to form the lead-in conductor 20 as explained earlier.

The antenna mounting base 14 comprises a base plate 30 with holes 32 to receive fasteners for attaching the base to a support. Extending from the base plate is a cylindrical base 34 which is sized to fit snugly within the base end of the antenna support tube 12. The tube may be bonded or otherwise secured to the base. Extending centrally through the mounting base 14 is a bore 36 through which passes the antenna lead-in conductor 20 and which is counterbored at the outer end to receive the coaxial antenna feed line 24. This coaxial line may be secured to the mounting base by a set screw 38. As mentioned earlier, the antenna lead-in conductor 22 is electrically joined to the center coaxial conductor 22.

The conductors 16 are sized and arranged to provide a linear antenna which is the approximate electrical equivalent of a conventional cylindrical antenna having a cylindrical conductor of the same diameter as the antenna support tube 12. To this end, the diameter of the conductors should be on the order of at least one skin depth. For relatively low frequencies, which in the context of the present disclosure are frequencies equal to or less than 100 $MH_z$, the conductor diameters should be on the order of 1–5 mils. The spacing between the adjacent conductors, within their major parallel portions, should be no greater than 1/100 of the lowest frequency at which the antenna is to operate.

The improved linear antenna of this invention, like a conventional cylindrical or stub antenna, presents the problem of providing an impedance match between the antenna proper, i.e., conductors 16, and the coaxial antenna feed line 24. The gathered base ends of the conductors which are electrically joined to form the lead-in conductor 20 provide the required impedance matching function. In other words, the gathered conductor ends constitute an impedance matching section 40 which provides a smooth impedance matching transition between the antenna and coaxial line. The axial dimension or length of this impedance matching section may be on the order of one-fourth the overall antenna length.

The parameters of the present linear antenna will vary with frequency desired bandwidth, gain, and other factors. By way of example, preliminary frequency bandwidth and efficiency tests have been conducted in connection with a test linear antenna according to the invention having a 1 inch diameter, 4 foot long support tube constructed of 3-mil thick MYLAR film. The antenna conductors comprises eight 5-mil BeCu wires. The tests indicated that the antenna had a resonant frequency of 150 $MH_z$ and a 1 db gain over a 30% frequency band width centered at the 150 $MH_z$ resonant frequency. These tests also indicated that the antenna gain was approximately the same as an equivalent stub antenna with a solid rod conductor. The present antenna, of course, was substantially lighter than the conventional stub antenna.

Figure 6:
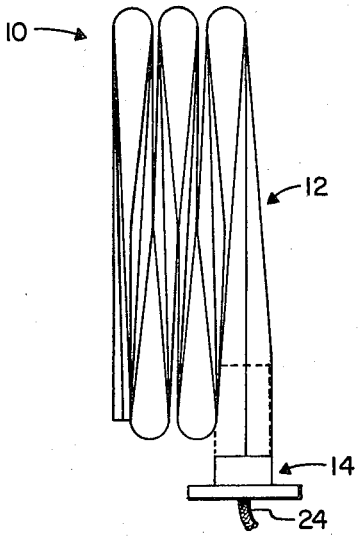
FIG. 6 illustrates the antenna in its contracted or packaged configuration.

The linear antenna 10 is designed to be flattened and folded to its stowage or packaged configuration of FIG. 6. When thus folded, the antenna stores elastic strain energy for erecting or deploying the antenna to its normal linear configuration of FIG. 1, when released.

Figure 7:
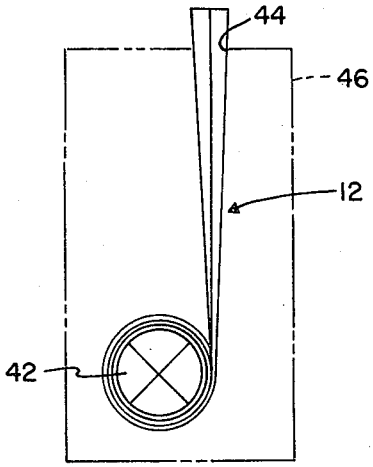
FIG. 7 illustrates an alternative antenna deployment and packaging technique.

FIG. 7 illustrates an alternative packaging technique wherein the antenna support tube 12 is contracted to its stowage or packaged configuration by winding it up on a drum 42. The antenna is deployed by unwinding it from the drum through an exit opening 44 in the drum housing 46. This exit opening is shaped to match the external cross-section of the expanded support tube. This modified packaging technique, of couse, would eliminate the mounting base 14.

As noted earlier, while the invention has been described as a single element or monopole linear antenna which is the equivalent of a conventional cylinder or stub antenna, it may also be arranged to operate as a cone antenna or as the individual elements of more complex multi-element antenna systems, such as those mentioned earlier.

We claim:

1. A linear antenna comprising:

a relatively thin walled, resiliently flexible, strain energy deployable dielectric tube adapted to be flattened and contracted to a packaged configuration wherein the tube stores elastic strain energy for restoring the tube to its normal linear tubular configuration, said tube having a base end;

mounting means at said base end for attaching said tube to a support;

slender flexible conductor wires spaced circumferentially about and extending along the tube wall generally parallel to the tube axis and having base ends at the base end of said tube;

stitching extending through the tube wall and around each conductor wire for securing said wires to the tube wall in a manner which accommodates relative endwise slippage between the wires and tube during contraction and deployment of the tube; and the base ends of said conductors being electrically joined.

2. A linear antenna according to claim 1 wherein:

said wires extend along the inner wall surface of said tube, and the base ends of said conductors are gathered and electrically joined to one another to form a single conductor.

3. A linear antenna according to claim 1 wherein:

said wires extend along the inner wall surface of said tube.

* * * * *